US005958204A

United States Patent [19]

Creech et al.

[11] Patent Number: 5,958,204

[45] Date of Patent: Sep. 28, 1999

[54] ENHANCEMENT OF COATING UNIFORMITY BY ALUMINA DOPING

[75] Inventors: George Edward Creech, Indianapolis; Paul Stephen Korinko, Greenwood; Michael Joe Barber, Indianapolis; Subhash K. Naik, Carmel, all of Ind.

[73] Assignee: Allison Enaine Company, Inc., Indianapolis, Ind.

[21] Appl. No.: 08/938,169

[22] Filed: Sep. 26, 1997

[51] Int. Cl.[6] ..... C25D 13/02

[52] U.S. Cl. ..... 204/487; 204/484; 204/491; 427/376.4; 427/376.8; 427/405; 148/518

[58] Field of Search ..... 204/491, 484, 204/487; 427/376.4, 376.8, 405; 148/518

[56] References Cited

U.S. PATENT DOCUMENTS

| | | | |
|---|---|---|---|
| 2,982,707 | 5/1961 | Scheible | 204/181 |
| 3,575,838 | 4/1971 | Hughes | 204/181 |
| 4,439,470 | 3/1984 | Sievers | 427/252 |
| 4,656,099 | 4/1987 | Sievers | 428/610 |
| 5,057,196 | 10/1991 | Creech et al. | 204/484 |

OTHER PUBLICATIONS

Smith, J.S. and Boone, D.H., "Platinum Modified Aluminides–Present Status", presented at the Gas Turbine and Aeroengine Congress and Exposition, Jun. 11–14, 1990, Brussels, Belgium.

*Primary Examiner*—Kishor Mayekar
*Attorney, Agent, or Firm*—Woodard, Emhardt, Naughton, Moriarty & McNett

[57] ABSTRACT

A method of controlling the final coating thickness of a diffused aluminide coating on a metal substrate. The method includes: (a) depositing an alumina-doped platinum-silicon powder onto a metal substrate, (b) heating the coated substrate to diffuse the platinum-silicon powder into the substrate and removing the undiffused scale, (c) depositing an aluminum-bearing powder onto the platinum-silicon-enriched substrate, and (d) heating the coated substrate to diffuse the aluminum-bearing powder into the substrate and removing the undiffused scale. The depositions are preferably done electrophoretically, in which case the Pt—Si deposition bath is doped with alumina or some other inert particulate. Alternatively, slurry deposition may be used. The method may also be used to deposit Pd—Si coatings onto metal substrates.

14 Claims, 19 Drawing Sheets

ENHANCEMENT OF COATING UNIFORMITY BY ALUMINA DOPING

FIELD OF THE INVENTION

The present invention relates generally to a method of controlling the final coating thickness of a diffused aluminide coating on a nickel- or cobalt-base superalloy substrate.

BACKGROUND AND DEVELOPMENT OF THE INVENTION

In the gas turbine engine industry, there continues to be a need for improved corrosion- and oxidation-resistant protective coatings for nickel-base and cobalt-base superalloy components, such as blades and vanes, operating in the turbine section of the gas turbine engine. The use of stronger superalloys that often have lower hot corrosion resistance, the desire to use lower grade fuels, the demand for longer life components that will increase the time between overhaul and the higher operating temperatures that exist or are proposed for updated derivative or new gas turbine engines underscore this continued need.

Diffused aluminide coatings have been used to protect superalloy components in the turbine section of gas turbine engines. In a typical example, an aluminide coating is formed by electrophoretically applying an aluminum-based powder to a superalloy substrate and heating to diffuse the aluminum into the substrate. Chromium is used to control the aluminum activity of the powder. Such coatings may include chromium or manganese to increase the hot corrosion/oxidation resistance thereof.

It is known to improve the hot corrosion- and oxidation resistance of simple diffused aluminide coatings by incorporating a noble metal, especially platinum, therein. Such platinum-enriched diffused aluminide coatings are now applied commercially to superalloy components by first electroplating a thin film of platinum onto a carefully cleaned superalloy substrate, applying an activated aluminum-bearing coating on the electroplated platinum coating and then heating the coated substrate at a temperature and for a time sufficient to form the platinum-enriched diffused aluminide coating on the superalloy substrate. Optionally, the platinum may be diffused into the substrate either prior to or after the application of the aluminum. e, g., "Platinum Modified Aluminides-Present Status," J. S. Smith, D. H. Boone (1990). The platinum forms an aluminide of $PtAl_2$ and remains concentrated toward the outer surface regions of the coating.

It is also known to improve the hot corrosion/oxidation resistance of diffused aluminide coatings by alloying the coating with silicon. Particularly, U.S. Pat. No. 5,057,196 to Creech et al. discloses a platinum-silicon coating which is electrophoretically deposited on a nickel or cobalt superalloy substrate. The deposited powder is heated to form a transient liquid phase on the substrate and initiate diffusion of Pt and Si into the substrate. An aluminum-chromium powder is then electrophoretically deposited on the Pt—Si enriched substrate and diffusion heat treated to form a corrosion- and oxidation-resistant Pt—Si enriched diffused aluminide coating on the substrate. The presence of both Pt and Si in the aluminide coating unexpectedly improves coating ductility as compared to a Pt-enriched diffused aluminide coating without Si on the same substrate material.

As further background, it is known that the ability to electrophoretically coat a conductive substrate depends on an electrophoretically active agent such as a zein/cobalt nitrate complex in the bath to produce a migration of the particles toward the substrate. In order to transfer coating particles from the bath suspension to the substrate, the zein complex must wet the coating particles. Because of this wetting, almost any particle compound (elemental powders, metal alloys, or ceramic compounds) can be electrophoretically deposited.

A typical bath composition contains 20–30 grams/liter of solids and 2–3 grams/liter of the soluble zein complex. Typically, the coating is deposited by using a direct current at a current density of 1–2 $mA/cm^2$ and a voltage necessary to drive the current.

The deposition of the green coat becomes self-leveling as time passes because once the coating thickness reaches a certain threshold, the deposition rate approaches zero. Provided this green coat thickness produces the desired diffused coating thickness for a particular substrate/coating combination, the final coating thickness is diffusion controlled. Coating systems with diffusion control are ideally suited for complex part geometries.

In cases where the as-deposited coating weight is beyond the desired mass per unit area, a way to control the final coating thickness is necessary. The simplest method is by controlling the weight applied by shortening the deposition cycle. In this method, the diffused coating thickness is determined by the amount of material deposited on the part. This method is not always satisfactory for coating complex shape parts though, since areas with locally high current densities end up with higher local green coat weights, while areas with locally lower current density areas end up with lower green coat weights. These uneven green coat weights produce an uneven diffused coating thickness.

Other possible variables that may afford improved uniformity of the applied green coat include: 1) anode shape, 2) anode to part distance, and 3) anode/cathode area ratio. However, if a thin uniform green coat is desired, experience has shown that the use of these factors is limited. The time required to produce a thin coating is not long enough for these parameters to be effective.

As an alternative to these prior art methods, the present invention provides a method for controlling coating thickness that relies on the diffusional flow of coating material. In this method, a sufficiently high quantity of coating is applied and the diffusion time and temperature determine the final coating thickness, with the remainder of the undiffused deposit being removed by a simple grit blast. For simple aluminide coatings (e.g., U.S. Pat. No. 3,748,110) the composition of the coating is such that the final diffused coating thickness is nearly independent of the applied coating thickness and diffusional control works very well. For parts with complex geometries, the areas of locally higher current density as well as those with lower current density have nearly the same diffused coating thickness provided a threshold green coat weight of about 15 $mg/cm^2$ is applied. Diffusion limited coating thickness is therefore a preferred method of controlling the final coating thickness because diffusion conditions are more easily controlled than green coat weight for complex shapes.

Accordingly, the present invention adapts current patent technology (e.g., the technology disclosed in U.S. Pat. No. 5,057,196) and modifies it to make the platinum-silicon (Pt—Si) application step one of diffusional control rather than of green coat weight control.

SUMMARY OF THE INVENTION

A method of controlling the final coating thickness of a diffused aluminide coating on a metal substrate. The method includes:

(a) depositing onto a metal substrate a platinum-silicon powder;

(b) applying a heat treatment to the coated substrate to initiate diffusion of the platinum-silicon powder into the substrate;

(c) removing the undiffused scale to leave a diffused Pt—Si enriched coating on the substrate;

(d) depositing an aluminum-bearing powder onto the Pt—Si enriched substrate;

(e) applying a heat treatment to the coated substrate to diffuse the aluminum-bearing powder into the substrate; and (f) removing the undiffused scale to leave a diffused Pt-modified aluminide coating on the substrate;

wherein said Pt—Si deposition is done using a Pt—Si powder that includes 5% to 20% by weight of an inert particulate such as alumina. Most preferably, both the Pt—Si deposition and the Al—Cr deposition are done electrophoretically, although slurry deposition, etc., may be used.

BRIEF DESCRIPTION OF THE DRAWINGS

FIG. 17 (FIGS. 17A–B) shows representative attack for each of the PtAl coatings

DESCRIPTION OF THE PREFERRED EMBODIMENT

For the purposes of promoting an understanding of the principles of the invention, reference will now be made to preferred embodiments and specific language will be used to describe the same. It will nevertheless be understood that no limitation of the scope of the invention is thereby intended, such alterations and further modifications in the described device, and such further applications of the principles of the invention as illustrated therein being contemplated as would normally occur to one skilled in the art to which the invention relates.

The present invention provides a method of controlling the thickness of the Pt—Si enriched layer and ultimately the Pt—Si modified aluminide coating microstructure on nickel and cobalt based superalloys. The Pt—Si enriched diffused layer thickness is controlled by adding an inert particulate, such as alumina to the Pt—Si electrophoretic bath. The alumina particulates are entrapped in the green coat and impede diffusion of the Pt—Si transient liquid phase.

Generally, the method comprises the steps of:

(a) depositing onto a metal substrate a platinum-silicon powder;

(b) applying a heat treatment to the coated substrate to diffuse the platinum-silicon powder into the substrate;

(c) removing the undiffused scale to leave a diffused Pt—Si enriched coating on the substrate;

(d) depositing an aluminum-bearing powder onto the platinum- and silicon-enriched substrate;

(e) applying a heat treatment to the coated substrate to diffuse the aluminum-bearing powder into the substrate; and (f) removing the undiffused scale to leave a diffused Pt-modified aluminide coating on the substrate;

wherein said Pt—Si deposition is done using a Pt—Si powder that includes 5% to 20% by weight of an inert particulate such as alumina. The deposition steps may be done using electrophoretic or slurry deposition, etc. Electrophoretic deposition is most preferred, and will be described in the following text and examples.

The present invention also contemplates a hot corrosion- and oxidation-resistant article comprising a nickel or cobalt superalloy substrate having a platinum and silicon-enriched diffused aluminide coating formed thereon and exhibiting improved coating uniformity and reduced rumpling without loss of corrosion- and oxidation-resistant properties.

Figure 1:
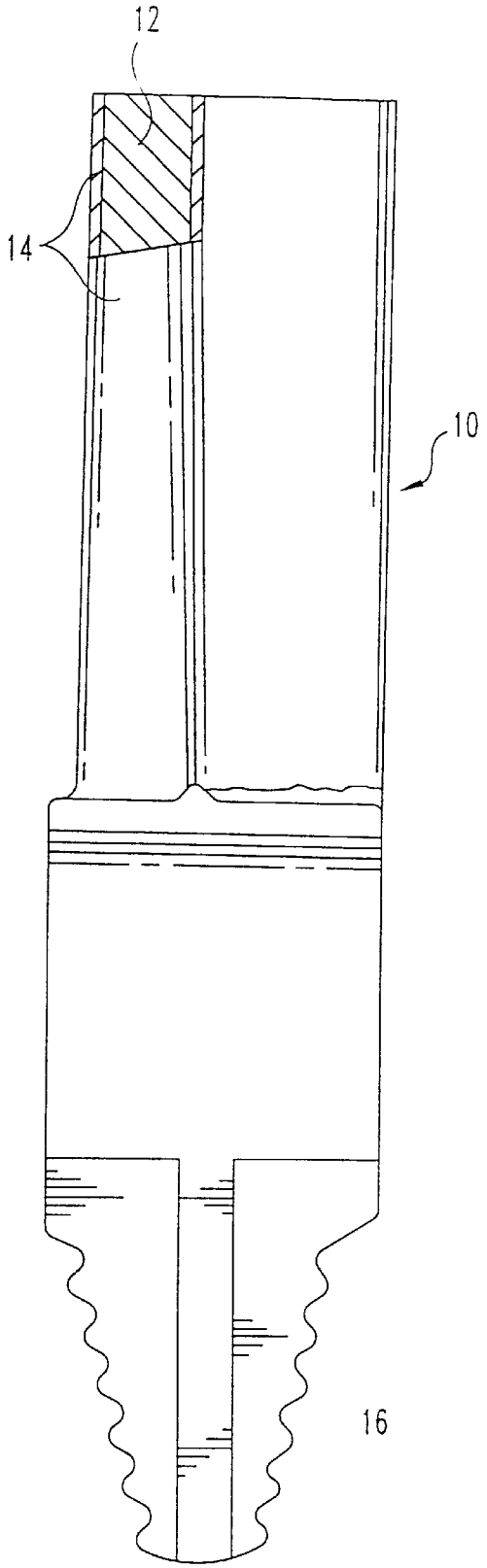
FIG. 1 shows a turbine blade with a superalloy body and a diffused platinum-silicon-enriched aluminide coating, according to one preferred embodiment of the present invention.

The subject coating method is particularly suitable for nickel- and cobalt-base superalloy castings such as, e.g., the type used to make blades and vanes for the turbine section of a gas turbine engine. FIG. 1 illustrates, for example, a turbine blade 10 formed of nickel or cobalt-base superalloy body portion 12 provided with a diffused platinum-silicon-enriched aluminide coating layer 14 as described in this specification. For purposes of illustration, the thickness of coating layer 14 is exaggerated in FIG. 1, the actual thickness being on the order of a few thousandths of an inch. It is usually unnecessary to provide the subject corrosion/oxidation-enriched coating layer over the fastening portion 16 of the blade 10.

The method of the present invention involves producing a modified diffused aluminide coating containing platinum and silicon on nickel or cobalt base superalloy substrates by a sequential two-step electrophoretic deposition process with an inert particulate such as alumina being included in the first electrophoretic bath to control the diffusion of Pt—Si into the coated substrate. The other aspects of the two-step electrophoretic deposition process (i.e., a diffusion heat treatment step following each electrophoretic deposition step) are generally as disclosed in applicant's earlier U.S. Pat. No. 5,057,196.

As with the '196 invention, the method of the present invention is especially useful in applying hot corrosion/oxidation resistant platinum and silicon-enriched diffused aluminide coatings having increased coating ductility and uniformity to components, such as blades and vanes, for use in the turbine section of gas turbine engines. FIG. 1 shows a typical turbine blade that may be coated with the present invention.

In a preferred embodiment of the invention, platinum and silicon are applied in the form of an alloy powder to the surface of a nickel or cobalt base superalloy substrate (e.g., nickel-base superalloys such as IN738, IN792, Mar-M246, Mar-M247, etc., single crystal nickel alloys such as CMSX-3 or CMSX-4, and cobalt-base superalloys such as Mar-M509, X-40, etc., all of which are known to those in the art) by a first electrophoretic deposition step. The alloy powder is prepared by mixing finely divided platinum powder with silicon powder of about one (1) micron particle size, compacting the mixed powders into a pellet and sintering the pellet in an argon atmosphere or other suitable protective atmosphere in a stepped heat treatment. One such heat treatment includes soaking (sintering) the pellet (1) at 1400° F. for 30 minutes, (2) at 1500° F. for 10 minutes, (3) at 1525° F. for 30 minutes, (4) at 1800° F. for 15 minutes and then (5) at 1900° F. for 30 minutes. The sintered pellet is reduced to approximately −325 mesh by pulverizing in a steel cylinder and pestle and then ball milling the pulverized particulate in a vehicle (60 wt % isopropanol and 40 wt % nitromethane) for 12 to 30 hours under an inert argon atmosphere to produce a platinum-silicon alloy powder typically in the 1 to 10 micron particle size range. Such alloy powder may also be produced by other suitable methods known in the art, such as gas atomization.

Silicon is included in the alloy powder in an amount from about 3 percent to about 50 percent by weight with the balance essentially platinum. A silicon content less than about 3 percent by weight is insufficient to provide an adequate amount of transient liquid phase in the subsequent diffusion heat treatment whereas a silicon content greater than about 50 percent by weight provides excessive transient liquid phase characterized by uneven coverage of the substrate. A preferred alloy powder composition includes about 10 percent by weight silicon with the balance essentially platinum.

The platinum-silicon alloy powder (about 90% Pt–10% Si by weight) is electrophoretically deposited on the nickel or cobalt base superalloy substrate after first degreasing the substrate and then dry honing (cleaning) the substrate using 220 or 240 grit aluminum oxide particles.

The electrophoretic deposition step is carried out in an electrophoretic bath that includes an inert particulate such as alumina. Preferably the particulate is finely ground. A sample electrophoretic bath is:

Electrophoretic Bath Composition (a) solvent: 60±5% by weight isopropanol, 40±5% by weight nitromethane (b) alloy powder: 15–30 grams alloy powder/liter of solvent (c) zein: 2.0–3.0 grams zein/liter of solvent (d) cobalt nitrate hexahydrate (CNH): 0.10–0.20 grams CNH/liter of solvent.

(e) alumina: 5–10% by weight

To effect electrophoretic deposition from the bath onto nickel or cobalt base superalloy substrates, the superalloy substrate is immersed in the electrophoretic bath and connected in a direct current electrical circuit as a cathode. A metallic strip (e.g., copper, stainless steel, nickel or other conductive material) is used as the anode and is immersed in the bath adjacent the specimen (cathode). A current density of about 1–2 mA/cm$^2$ is applied between the substrate (cathode) and the anode for 1 to 3 minutes with the bath at room temperature. During this time, the platinum-silicon alloy powder coating is deposited as a uniform-thickness alloy powder deposit on the substrate. The weight of the coating deposited is typically about 7–20 mg/cm$^2$ of substrate surface, although coating weights from about 5 to 25 mg/cm$^2$ are suitable.

The coated substrate is then removed from the electrophoretic bath and air dried to evaporate any residual solvent.

The dried, coated substrate is then subjected to a diffusion heat treatment in a hydrogen, argon, vacuum or other suitable protective atmosphere furnace. Temperatures of about 2000° F. and diffusion times of about 8 to about 30 minutes are preferably used for nickel-base superalloy substrates. Temperatures of about 1900° F. and diffusion times of about 30 to 60 minutes are preferably used for cobalt-base superalloy substrates. Generally, temperatures between about 1800° F. and about 2200° F. are used, depending on the substrate. Following the diffusion heat treatment, the coated substrate is cooled to room temperature.

The temperature and time of the diffusion heat treatment are selected to melt the deposited platinum-silicon alloy powder coating and form a transient liquid phase evenly and uniformly covering the substrate surface to enable both platinum and silicon to diffuse into the substrate. Typically, the platinum-silicon-enriched diffusion zone on the substrate is about 0.5 to 1.5 mils in thickness and includes platinum and silicon primarily in solid solution in the diffusion zone.

As mentioned hereinabove, the composition of the platinum-silicon alloy powder (preferably 90% Pt–10% Si by weight) is selected to provide an optimum transient liquid phase for diffusion of platinum and silicon into the substrate during the first diffusion heat treatment.

Following the first diffusion heat treatment, the platinum-silicon-enriched superalloy substrate is cleaned by dry honing lightly with 220 or 240 grit aluminum oxide particulate.

After cleaning, the platinum-silicon-enriched superalloy substrate is coated with an aluminum-bearing deposit by a second electrophoretic deposition step. Preferably, for nickel-base superalloy substrates, a prealloyed powder comprising, e.g., either (1) 55 wt % aluminum and 45 wt % chromium or (2) 42 wt % aluminum, 40 wt % chromium and 18 wt % manganese is electrophoretically deposited on the substrate. For cobalt superalloy substrates, a prealloyed powder comprising, e.g, either (1) 65 wt % aluminum and 35 wt % chromium or (2) 70 wt % aluminum and 30 wt % chromium is preferably electrophoretically deposited on the substrate.

The electrophoretic deposition step is carried out under the same conditions set forth hereinabove for depositing the platinum-silicon alloy powder with, however, the aluminum-bearing powder substituted for the platinum-silicon alloy powder in the electrophoretic bath and no alumina being necessary in the bath. The same quantity (e.g., 15–30 grams of aluminum-bearing alloy powder) is employed per liter of solvent to electrophoretically deposit the aluminum-bearing alloy powder onto the substrate.

The aluminum-bearing powder coating is electrophoretically deposited with coating weights in the range of about 15 to about 40 mg/cm$^2$ regardless of the composition of the aluminum-bearing coating and the composition of the substrate.

After the aluminum-bearing powder coating is electrophoretically deposited, the coated substrate is air dried to evaporate residual solvent.

Thereafter, the dried, aluminum-bearing powder coated substrate is subjected to a second diffusion heat treatment in a hydrogen, argon, vacuum or other suitable atmosphere furnace to form a platinum and silicon-enriched diffused aluminide coating on the substrate. For nickel-base superalloy substrates, the second diffusion heat treatment is preferably carried out at about 1975–2100° F. for about 2 to 4 hours. For cobalt-base superalloy substrates, the second diffusion heat treatment is conducted at a temperature of about 1800–1900° F. for about 2 to 5 hours.

The diffused aluminide coating formed by the second diffusion heat treatment typically is about 2 to 5 mils in thickness and typically includes a two-phase platinum-rich outer zone. The platinum content of the diffused aluminide coating produced in accordance with the invention is typically in the range from about 15 to about 35 wt % adjacent the outer surface of the coated substrate (i.e., about the same as conventionally applied Pt-enriched diffused aluminide coatings). The silicon content of the coating of the invention is typically in the range from about 0.5 to about 10 wt % near the substrate/coating interface.

Reference will now be made to specific examples using the processes described above. It is to be understood that the examples are provided to more completely describe preferred embodiments, and that no limitation to the scope of the invention is intended thereby.

General Experimental

Testing was performed to show that doping the Pt—Si electrophoretic bath with fine particles of alumina allows the coating microstructure to be controlled over a broader green coat weight range than when an undoped Pt—Si electrophoretic bath is used. The effect of particle size of the alumina is also noted. A brief high temperature oxidation screening test differentiated between PtAl coatings which were prone to "rumpling" and those which were not. Addition of alumina in the first step did not adversely affect the dynamic oxidation resistance of the coating after 300 hr of testing.

Figure 2:
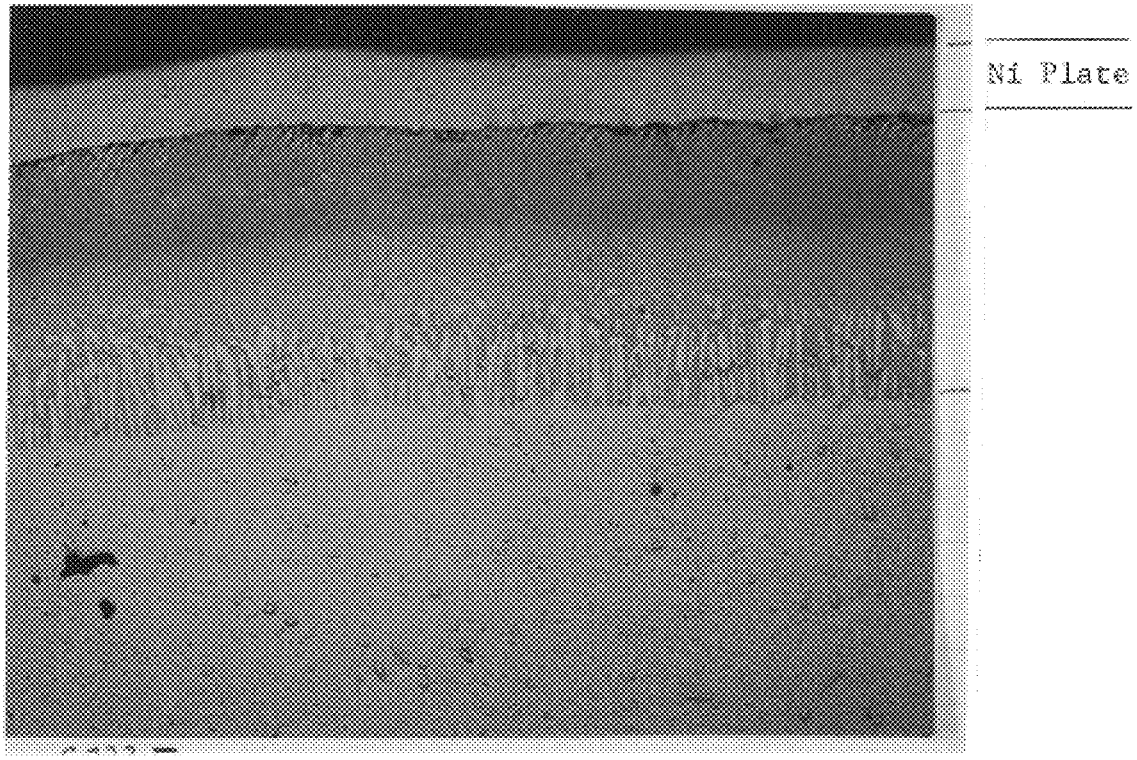
FIG. 2 shows the normal coating microstructure of the prior art PtAl coating on IN738.
Figure 3:
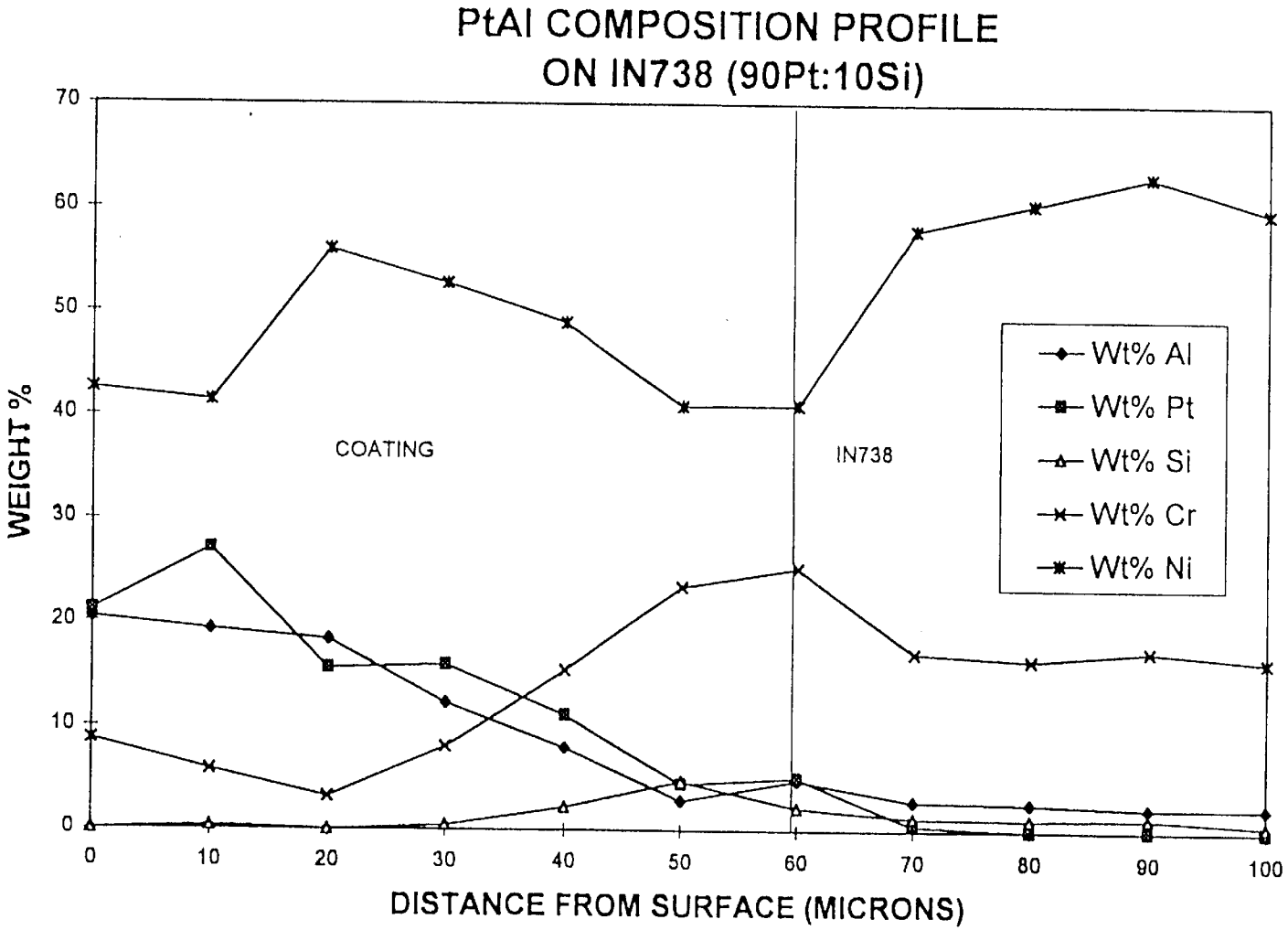
FIG. 3 shows the composition profile of a prior art PtAl coating.

FIG. 2 shows the normal coating microstructure of the prior art PtAl coating on IN738. The green coat weights on the ⅛" pins were intentionally kept low. The minimum wt % of 10% Pt and 18% Al specified for PtAl on nickel superalloy substrates were met. FIG. 3 shows the composition profile for this coating.

Figure 4:
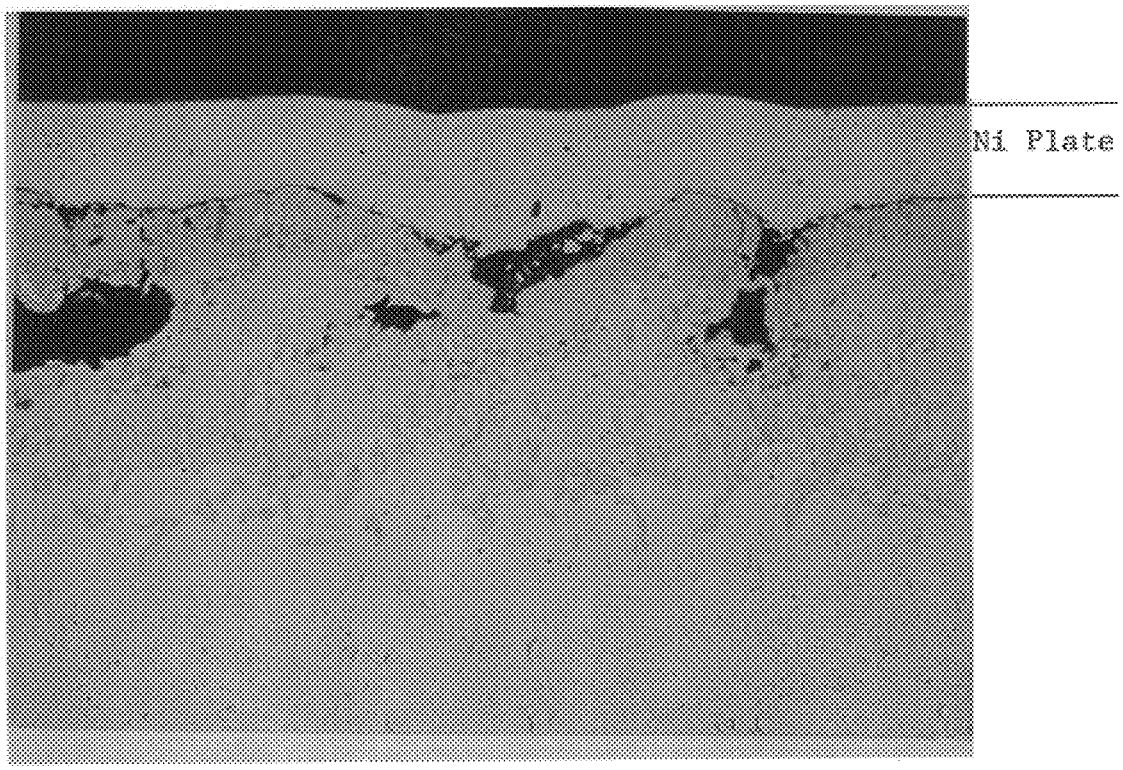
FIG. 4 shows the unetched microstructure for a prior art PtAl coating showing porosity in the coating.

FIG. 4 shows unetched microstructures for prior art PtAl coatings having some porosity in the coating. This represents the same type of Pt—Si composition as shown above. The porosity tends to develop in the coating as the Pt—Si green coat weight is increased. The diffusion zone within the coating microstructure also changes from a well defined columnar structure to more random "fingering" zone as can be seen in FIG. 4.

Figure 5:
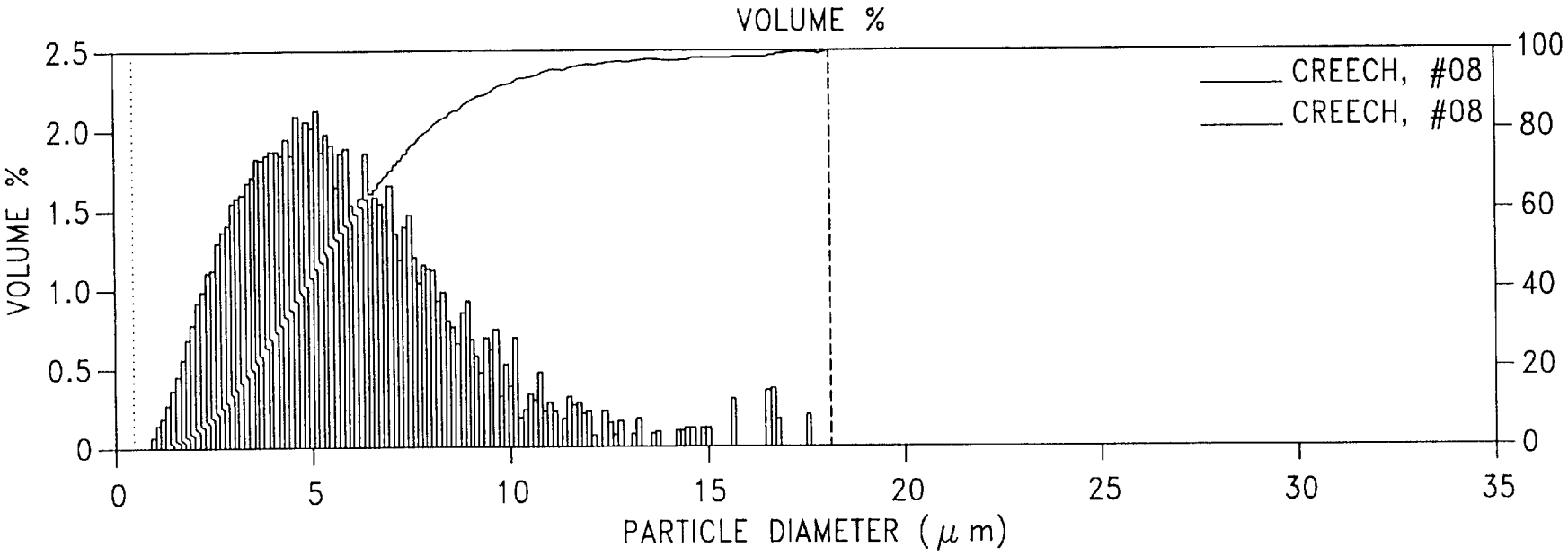
FIG. 5 shows the particle size distribution of the alumina used in the doping experiments.

Early experiments using tabular alumina which was ball milled for 15 hr (hereafter referred to as coarse alumina; particle size distribution shown in FIG. 5) showed promise in controlling the diffusion efficiency of the Pt—Si and thereby controlling the prior art coating microstructure and preventing porosity within the coating. Based on these early experiments, a 10 to 15 wt % addition of alumina seemed to offer the degree of control desired.

EXAMPLE 1

Alumina Doping Optimization

Figure 6:
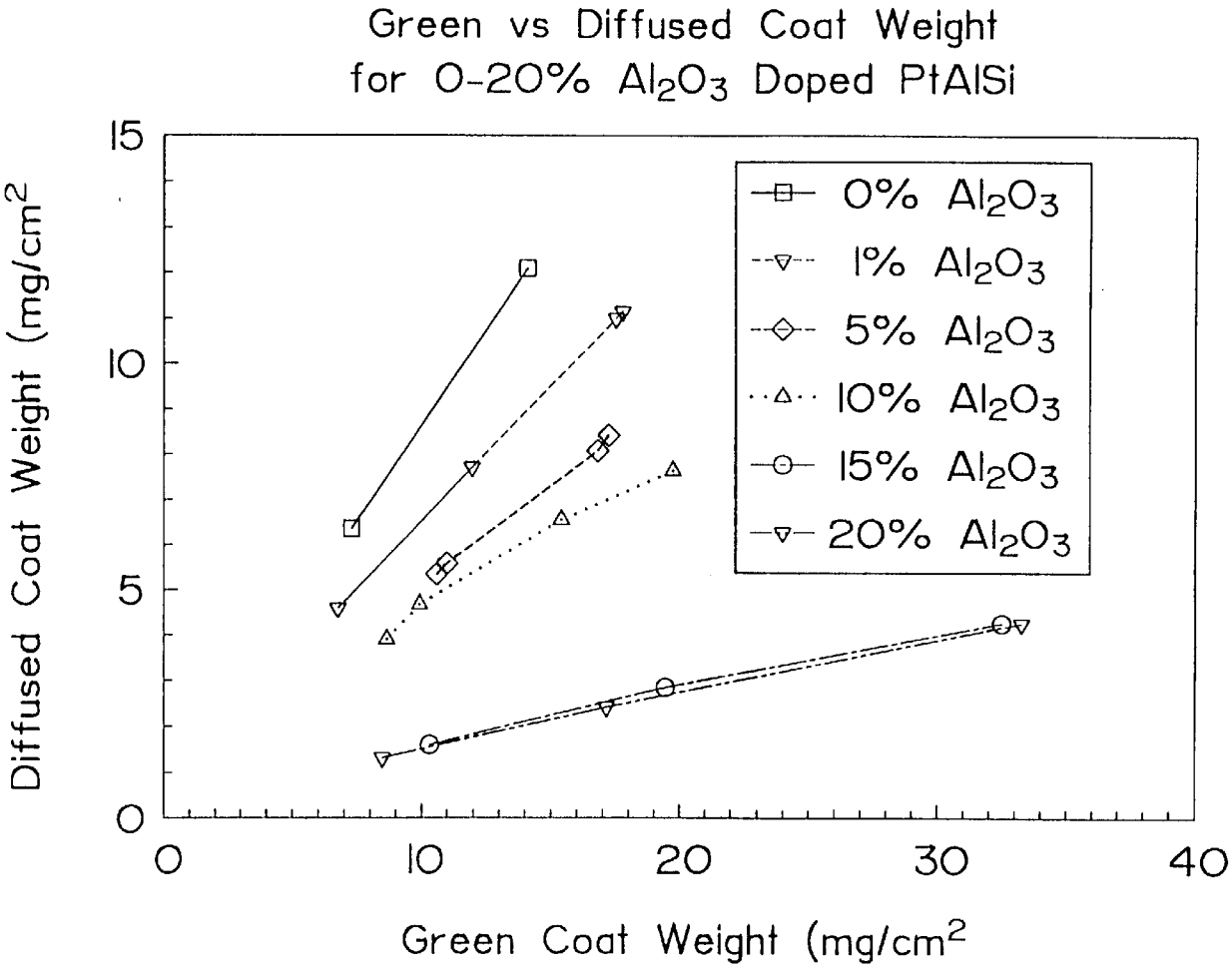
FIG. 6 is a graph showing the effect of alumina doping at levels of from 0% to 20% for alumina with particle size distribution as shown in FIG. 5.

FIG. 6 shows the results of coarse alumina doping optimization tests. Based on the coarse aluminum optimization, baths A and B were formulated with 10 and 15 wt %, respectively, of fine alumina. Trials with ⅛" pins showed very little weight gain after diffusing the green coat for the normal diffusion time and temperature. This level of alumina doping inhibited the diffusion process. These results were attributed to the differences in particle sizes of the two types of alumina. The fine alumina more severely restricts the diffusion of the Pt—Si than the coarse alumina.

Consequently, baths C and D were prepared at 2 and 5 wt % doping levels, respectively. Evidently this level was too low. The coating thickness after diffusion of Pt—Si green coat deposits on ⅛" IN738 pins exceeded the coating thickness allowed by the process specification for the prior art coating.

Doping at a nominal 7 wt % of the fine alumina (Bath E) gave the desired degree of control on the coating thickness and coating microstructure. TABLE I shows the average, minimum, and maximum thicknesses for inventive PtAl coating on ⅛" pins of IN738 coated from Bath E. The microstructures were free of voids within the coating and free of coating pits over a wide range of Pt:Si green coat weights until the green coat weight exceeded about 20 mg/cm$^2$ (G782). The green coat weight of the Al:Cr was held relatively constant for the second step.

TABLE I

| ID | Pt—Si + 7% $Al_2O_3$ GREEN COAT WEIGHT (mg/cm$^2$) | AVERAGE COATING THICKNESS (mils) | MINIMUM COATING THICKNESS (mils) | MAXIMUM COATING THICKNESS (mils) |
|---|---|---|---|---|
| G784 | 7.19 | 2.24 | 1.91 | 2.50 |
| G795 | 8.63 | 2.41 | 2.06 | 2.79 |
| G796 | 12.5 | 2.48 | 2.21 | 2.65 |
| G797 | 19.2 | 2.60 | 2.21 | 2.94 |

Figure 7:
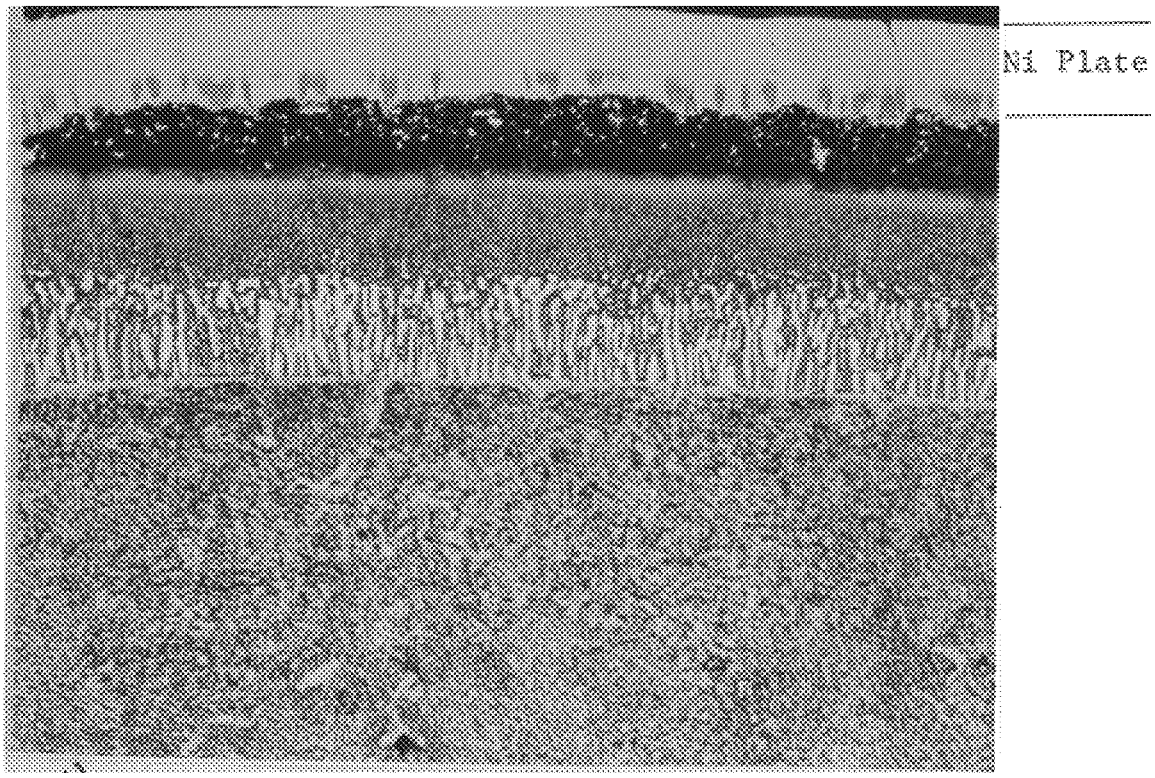
FIG. 7 shows the inventive PtAl coating microstructure for sample G797 of TABLE I.

FIG. 7 shows the inventive PtAl coating microstructures for sample G797 shown in TABLE I. Note the range of coating thicknesses shown in Table I all fell within the 1.5 to 3.5 mils range required.

EXAMPLE 2

Static Oxidation Screening Tests

When porosity occurs within the coating microstructure, experience has shown that high temperature exposures for short times may be used as a screening test to determine the coating durability.

Figure 8A:
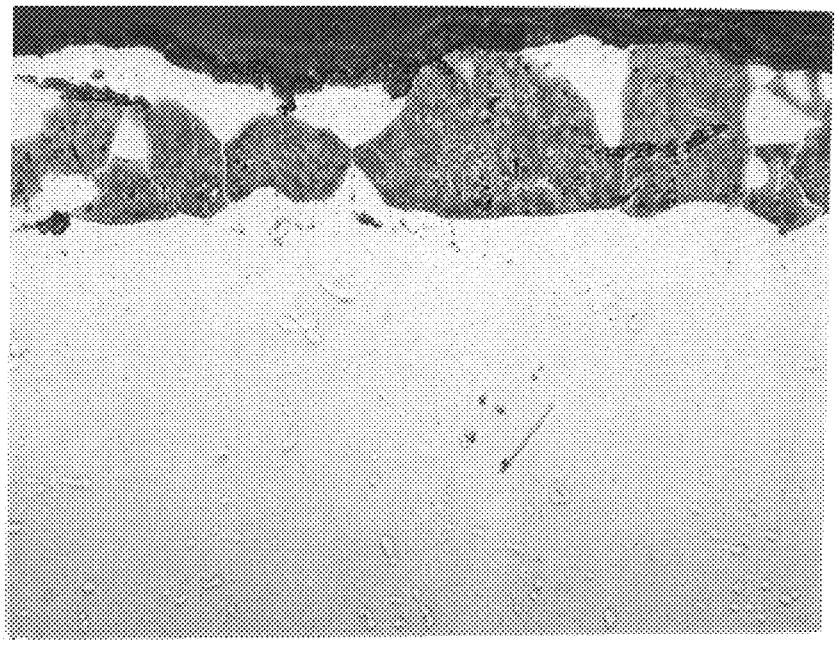
FIG. 8 (FIGS. 8A–B) shows typical cross sections of tested pins.
Figure 8B:
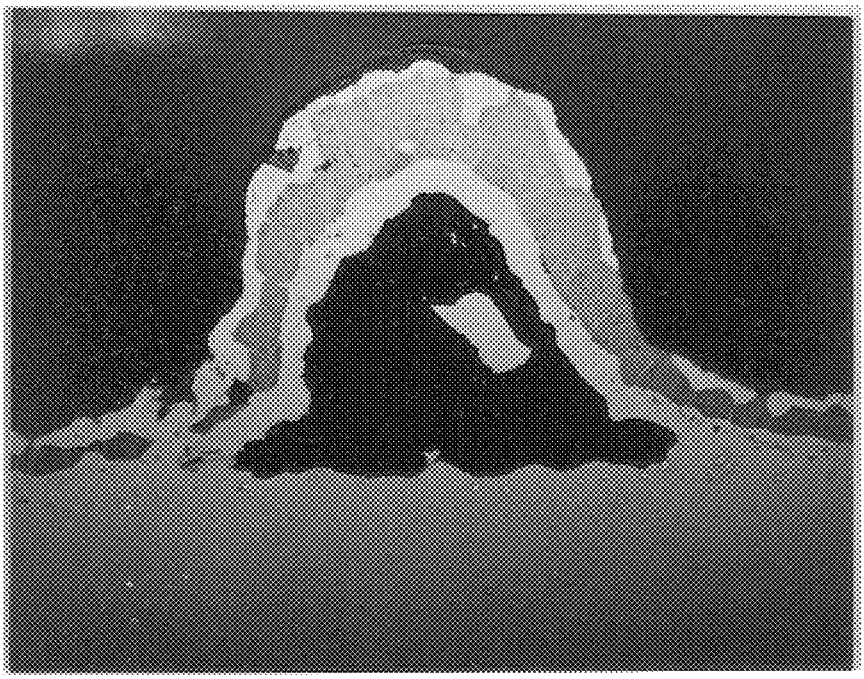

FIG. 8A shows the typical appearance of the etched prior art coating microstructure on a pin after exposure at 2150° F. for 24 hrs. The Pt—Si was deposited from a 10 liter bath. The coating was diffused in hydrogen rather than argon normally used. Porosity within the coating and high temperature exposure caused rumpling of the coating at three locations on the pin circumference. One of these is shown in FIG. 8B.

EXAMPLE 3

Inventive PtAl Coating Characterization-Static Oxidation Behavior

In order to mitigate the rumpling problem, we turned to alumina doping in the first step to control the diffusion efficiency of the Pt—Si deposit. This is particularly important in areas where the green coat is heavier in high current density areas, such as leading and trailing edges (and shroud and platform edges) on turbine blades and vanes. While the green coat can be carefully controlled on simple shapes such as round pins, the green coat weight in localized areas is likely to vary on complex shapes such as multiple airfoil vanes.

Figure 9A:
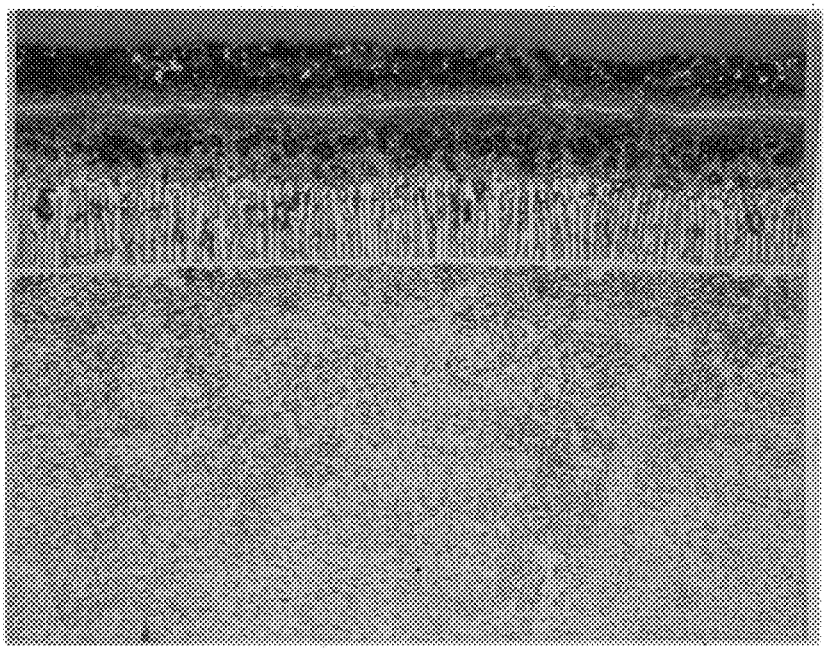
FIG. 9 (FIGS. 9A–B) shows an as-diffused inventive PtAl coating produced from Bath G with 7 wt % alumina, and the same coating after 24 hr exposure at 2150° F. in air.
Figure 9B:
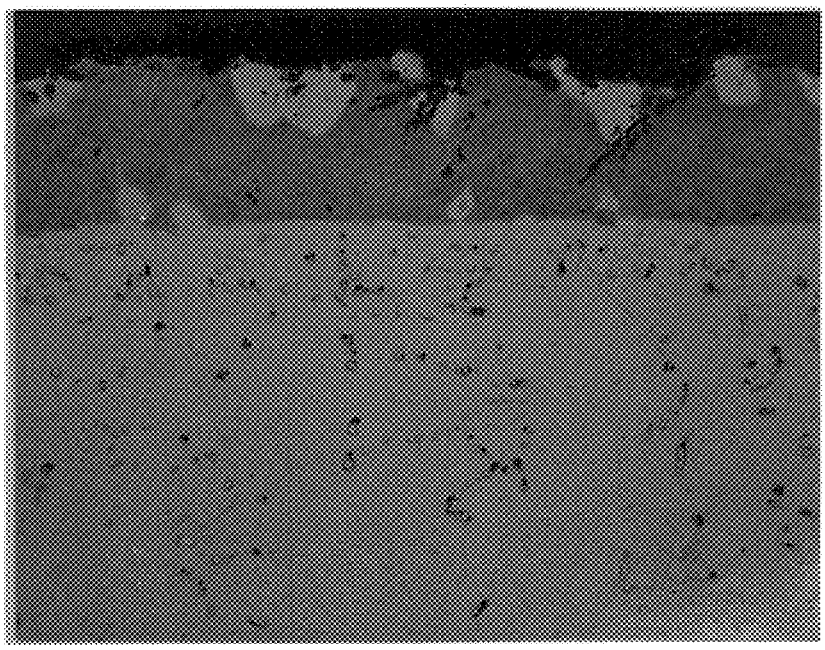

The importance of the level of alumina doping, particle size distribution of the alumina, and green coat weight have been previously discussed. Coatings, according to the present invention, were produced from baths F, G, and H which were doped with 7 wt % fine alumina yielded similar results as Bath E (TABLE I). FIG. 9 shows a sample from an as-diffused inventive PtAl coating produced from Bath G with 7 wt % alumina and the same coating after 24 hr exposure at 2150° F. in air. It is important to note that there was no rumpling after thermal exposure. FIGS. 9A and 9B show the as-diffused coating, and after thermal exposure, for pin G815, with a green coat weight of 22.7 mg/cm$^2$. No rumpling was observed after the 2150° F.-24 hr thermal exposure. The inventive coatings spanning nearly a 3-fold range of Pt—Si green coat weights were acceptable after the 2150° F.-24 hr screening test. Table II summarizes the data for the inventive coatings from Bath G.

TABLE II

| ID | Pt—Si + 7% $Al_2O_3$ GREEN COAT WEIGHT (mg/cm$^2$) | AVERAGE COATING THICKNESS (mils) | MINIMUM COATING THICKNESS (mils) | MAXIMUM COATING THICKNESS (mils) |
|---|---|---|---|---|
| G814 | 11.1 | 2.35 | 2.21 | 2.50 |
| G815 | 22.7 | 2.54 | 2.35 | 2.65 |
| G816 | 30.5 | 2.34 | 2.06 | 2.94 |

A similar series of coatings were produced from Bath H spanning a Pt—Si green coat weight range of 9.45 to 23.7 mg/cm$^2$ for which the 2150° F.-24 hr cycle did not produce rumpling. Rumpling was only observed for coatings according to the present invention after the same thermal exposure as the Pt—Si green coat weight was increased to 34.4 mg/cm$^2$. Such a green coat weight is well outside the normal process limits.

Figure 10A:
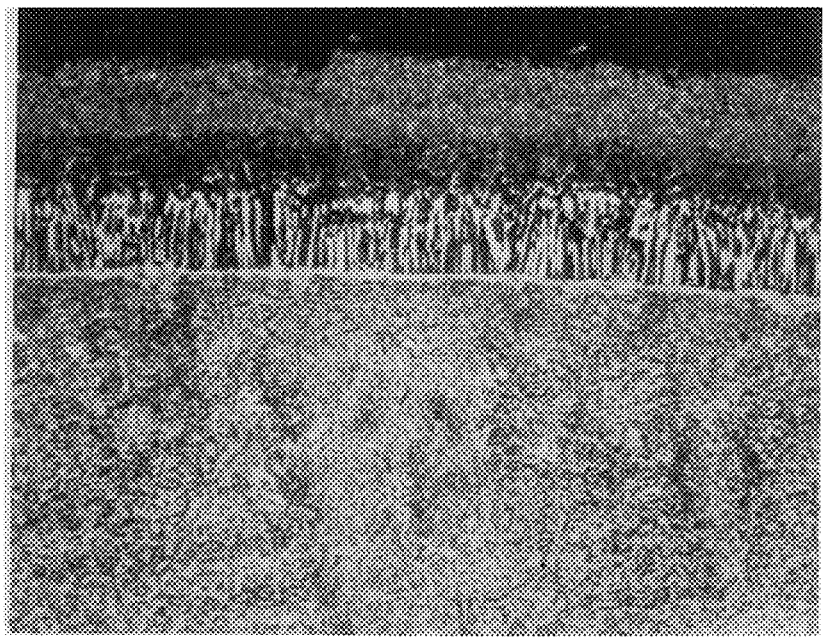
FIG. 10 (FIGS. 10A–B) shows the as-diffused coating from Bath H, and the same coating after 24 hr exposure in air.
Figure 10B:
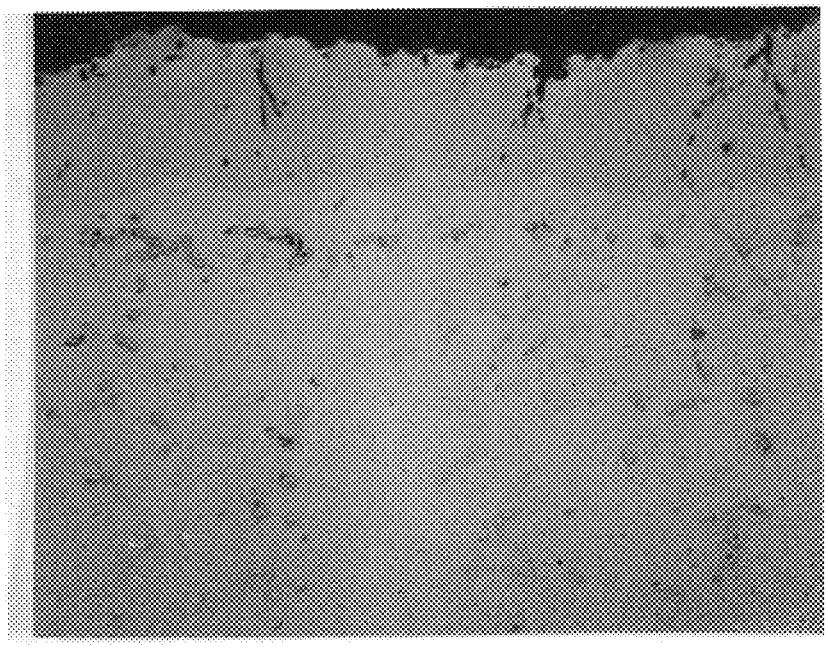

FIGS. 10A and 10B show the coating on sample G819 from bath H in the as-diffused and post-exposure conditions (i.e., after thermal exposure at 2150° F. for 24 hours). Table III summarizes the data for the inventive PtAl coatings from Bath H for which the Pt—Si+$Al_2O_3$ green coat weight was varied. Each of the coatings had similar Al—Cr green coat weights in the second step.

TABLE III

| ID | Pt—Si + 7% $Al_2O_3$ GREEN COAT WEIGHT (mg/cm$^2$) | AVERAGE COATING THICKNESS (mils) | MINIMUM COATING THICKNESS (mils) | MAXIMUM COATING THICKNESS (mils) |
|---|---|---|---|---|
| G817 | 9.45 | 2.23 | 2.06 | 2.35 |
| G818 | 17.4 | 2.26 | 2.06 | 2.35 |
| G819 | 23.7 | 2.33 | 2.21 | 2.50 |

EXAMPLE 4

Diffused Coating Composition

Figure 11:
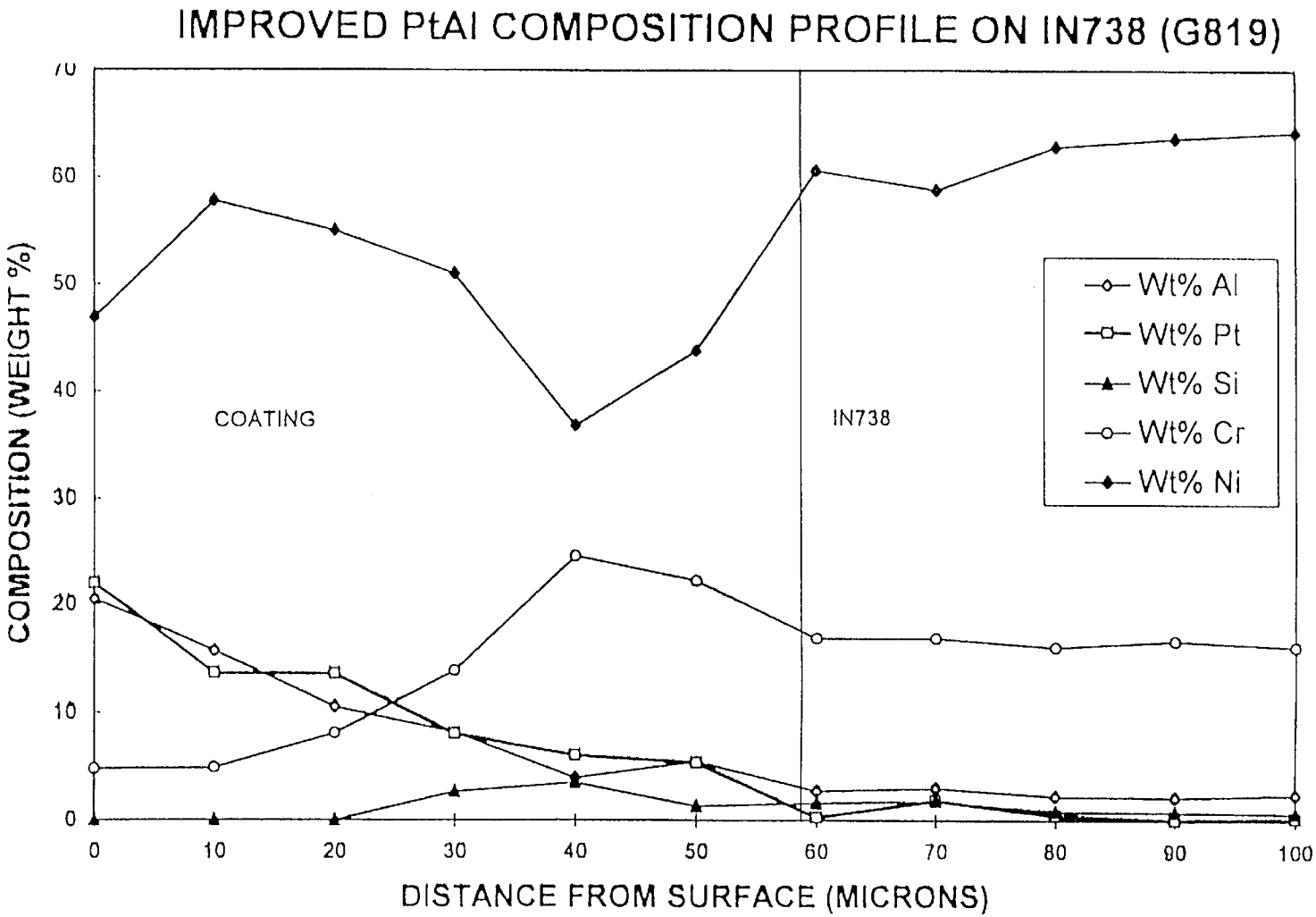
FIG. 11 shows the XEDA results of microprobe coating composition analysis for the inventive coating.

Microchemical coating composition analyses using a SEM equipped with X-ray energy dispersive analysis (XEDA) were performed on sample G819 to establish a correlation between the Pt—Si+$Al_2O_3$ green coat weight in the first step and the final diffused composition versus the wt % of Pt and Al required. FIG. 11 shows the XEDA results. The coating on the sample met the 20 wt % Al and 10 wt % Pt minimums. A twofold range of green coat exists for the first step that will meet the composition requirement.

EXAMPLE 5

Dynamic Oxidation Testing

Dynamic oxidation testing was done in a high velocity Becon rig at 2000° F. The high velocity and the cyclic nature of this test more closely matches engine operating conditions than a static oxidation test.

Figure 12:
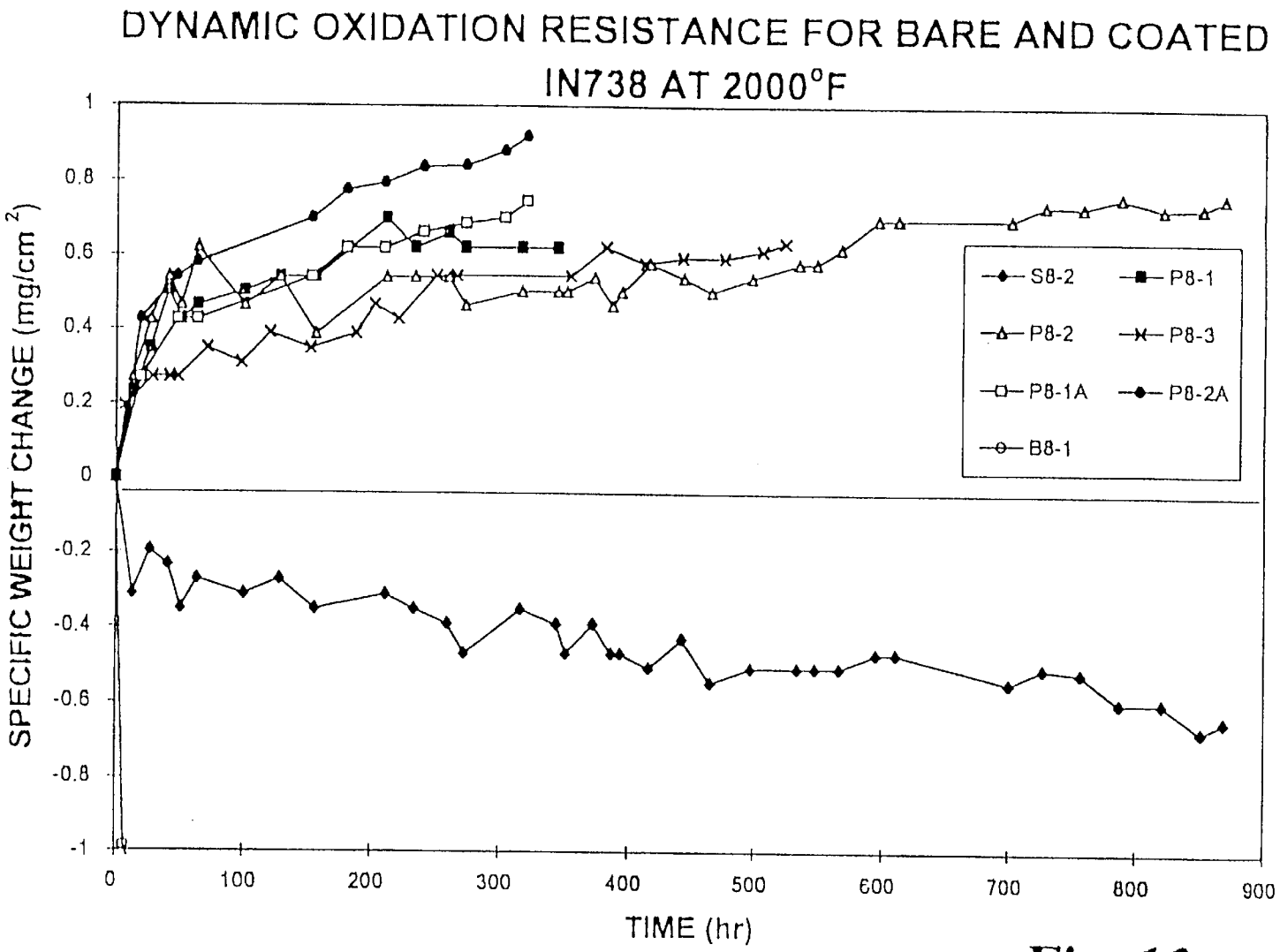
FIG. 12 shows the weight change that bare and coated IN738 samples experienced during testing at 2000° F.

FIG. 12 shows the weight change that bare and coated IN738 samples experienced. As can be seen from the Figure, PtAl coatings (samples P8-1, P8-2, P8-3, P8-1A and P8-2A) were clearly better than simple aluminide (pin S8-2), and bare (pin B8-1) IN738. Pins P8-1A and P8-2A were coated with the inventive coating from bath E with a nominal 7 wt % alumina doped Pt—Si. After 300 hr, the inventive coating weight change was similar to prior art coatings on IN738. This suggests that alumina doping used for process control does not adversely affect the dynamic oxidation resistance of the PtAl.

EXAMPLE 6

Hot Corrosion Testing

Hot corrosion testing was performed in a low velocity, atmospheric pressure, hot corrosion burner rig under Type I hot corrosion conditions. The test conditions were as follows:

Temperature: 1650° F.

Time: 1000 Hr

Wt % Sulfur: 1%

Sea Salt Contaminant: 10 ppm

Fuel: #2 diesel

The effect of the corrosive environment on the pins was monitored periodically. Macro photographs were taken of the pins when significant changes were observed.

The testing showed:

1. An alumina doped PtAl coating performed as well as the standard PtAl coating on IN738;

2. PtAl and inventive (i.e., doped) PtAl had similar hot corrosion resistance as conventional PtAl on IN738.

Macro photographs at 250, 300, 500, 700, and 1000 hr were taken to document the surface conditions of the coated pins as a function of time. (The inventive coating used in this example is a coarse alumina doped PtAl produced by including 10 wt % alumina in the Pt:Si deposit in the first step of the coating process.)

Figure 13A:
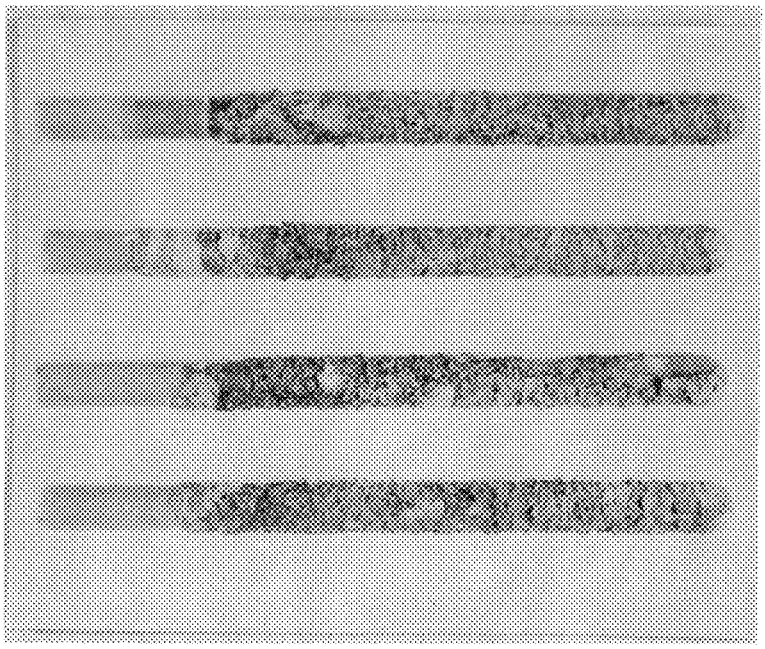
FIG. 13 (FIGS. 13A–C) shows a comparison of prior art PtAl coatings (FIG. 13B) and the inventive PtAl coatings (FIG. 13C) compared to simple aluminide coatings (FIG. 13A) on IN738 after 500 hr of hot corrosion exposure.
Figure 13B:
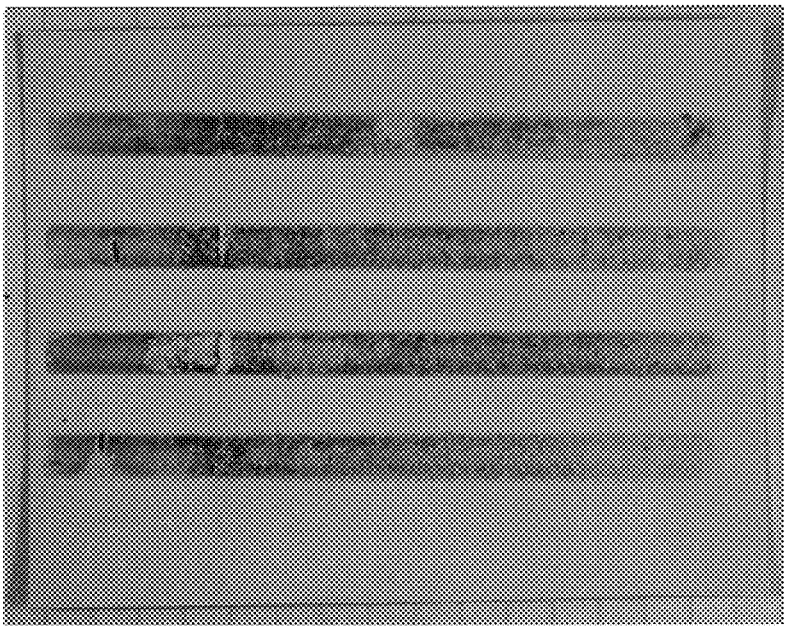
Figure 13C:
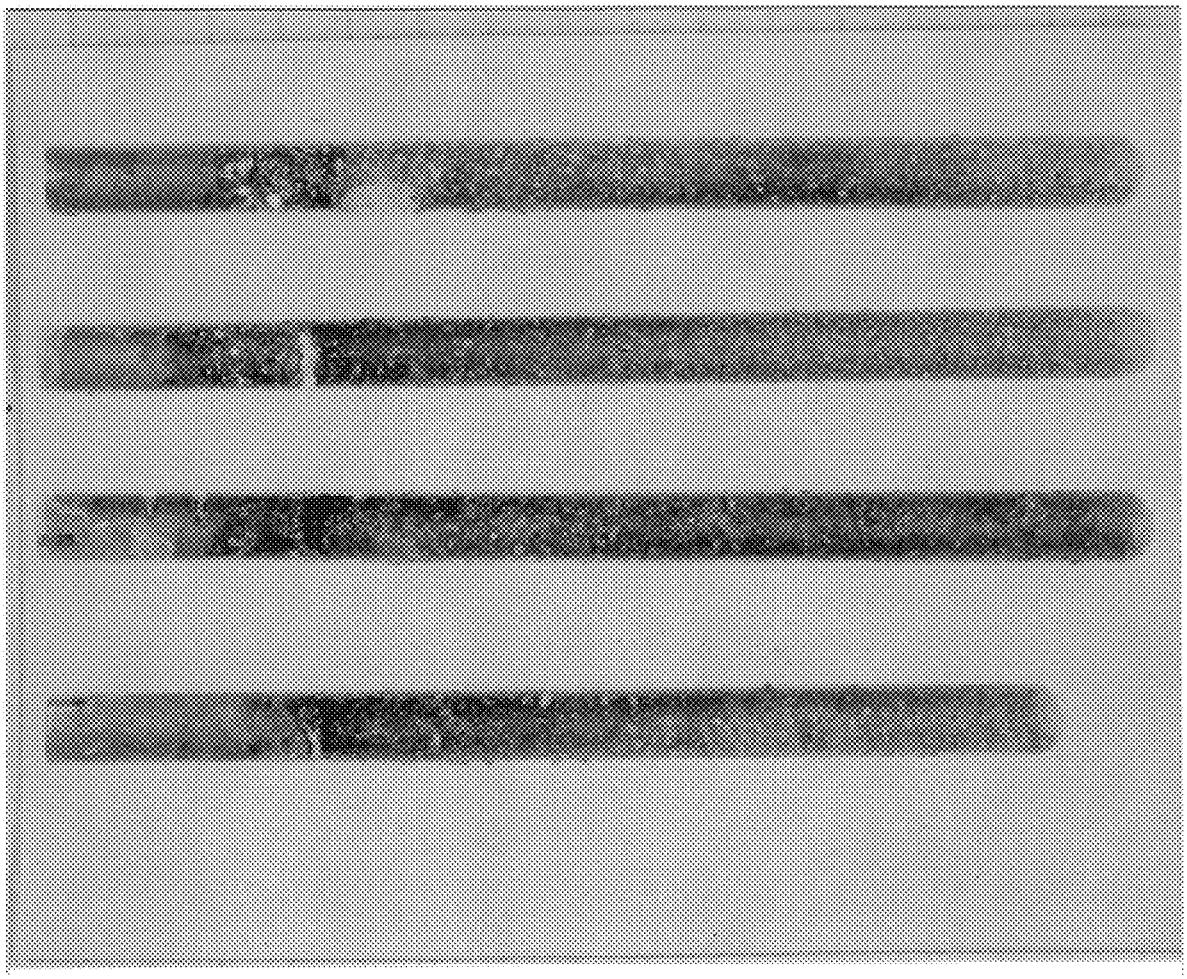

At 500 hr, simple aluminide on IN738 showed significant scaling type attack while prior art PtAl and the inventive PtAl coatings only showed a slight roughening of the pin surface as documented in FIGS. 13A–C. Comparative examples showed a complete attack of the simple aluminide on IN738 with spalling occurring on some pins, while the 700 hr exposure created some roughening on the prior art PtAl and inventive PtAl coatings.

Figure 14A:
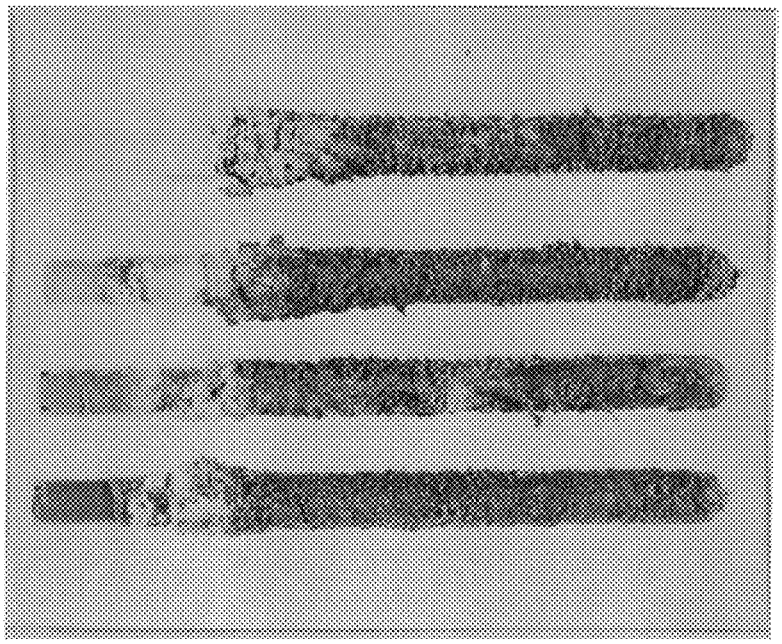
FIG. 14 (FIGS. 14A–C) shows a comparison of prior art PtAl coatings (FIG. 14B) and the inventive PtAl coatings (FIG. 14C) compared to simple aluminide coatings (FIG. 14A) on IN738 after 1000 hr of hot corrosion exposure.
Figure 14B:
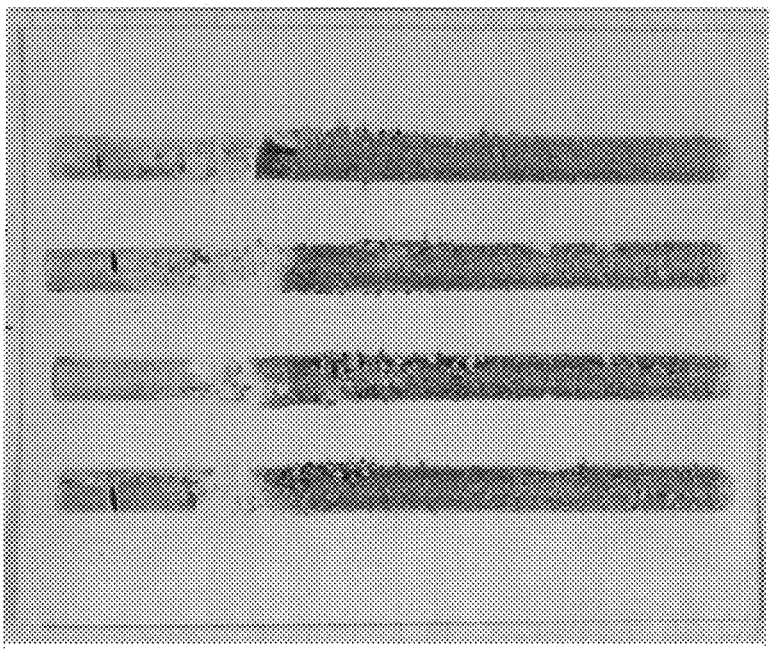
Figure 14C:
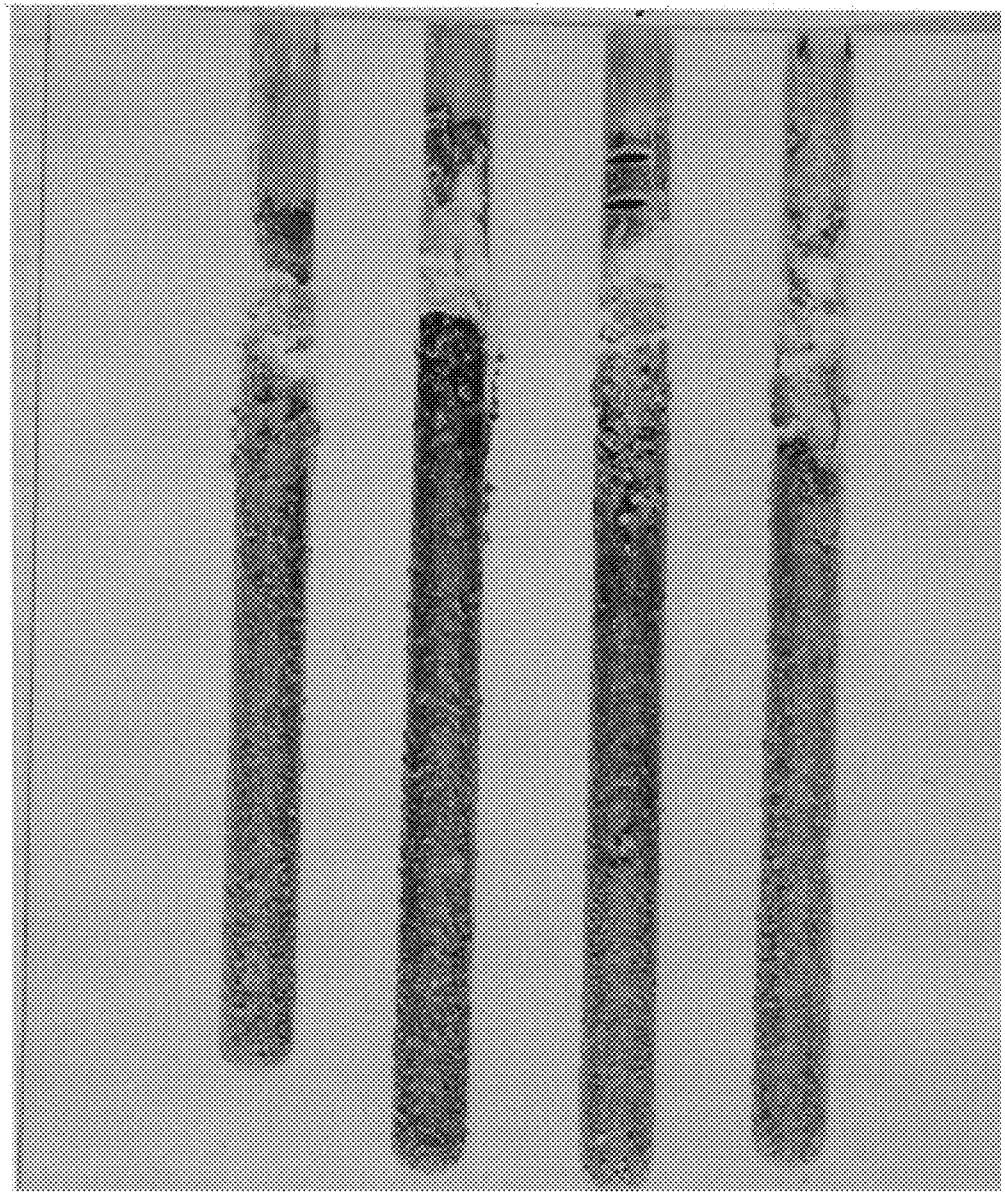

After 1000 hr, the simple aluminide coating on IN738 had been completely penetrated while prior art PtAl and inventive PtAl coatings exhibited some corrosion whiskers signaling the onset of corrosion attack as displayed in FIGS. 14A–C.

Figure 15:
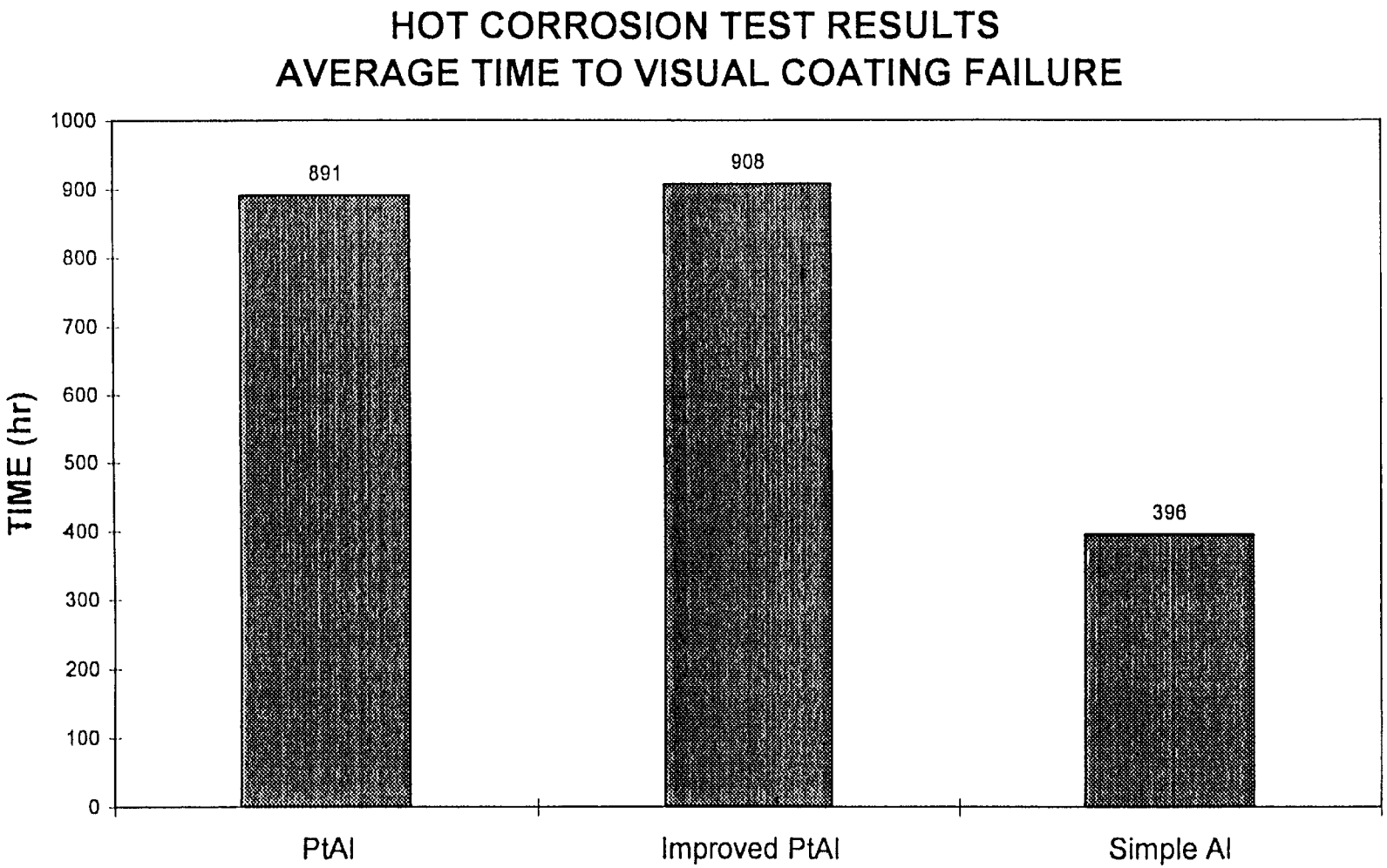
FIG. 15 is a chart of the hot corrosion test results, showing the time to visual coating failure at 1650° F.

A ranking of the corrosion resistance of certain material/coating combinations with the estimated time to visual coating failure at 1650° F. is listed below and plotted in FIG. 15.

| Substrate/Coating | Avg Time to Visible Failure (Hr) |
|---|---|
| IN738/Improved PtAl | 908 |
| IN738/Prior Art PtAl | 891 |
| IN738/Simple aluminide | 396 |

Figure 16:
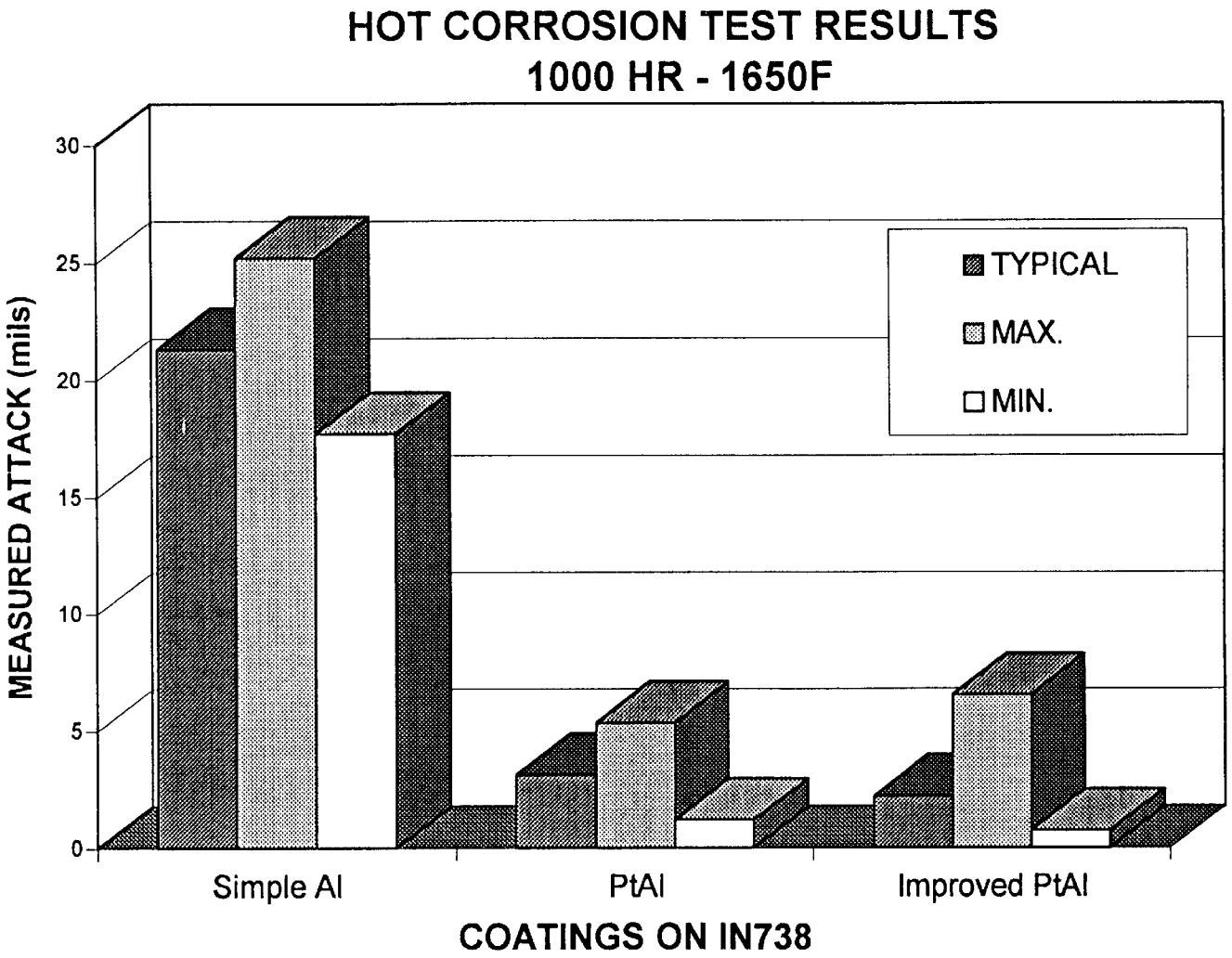
FIG. 16 is a chart of the hot corrosion test results after 1000 hr at 1650° F.
Figure 17A:
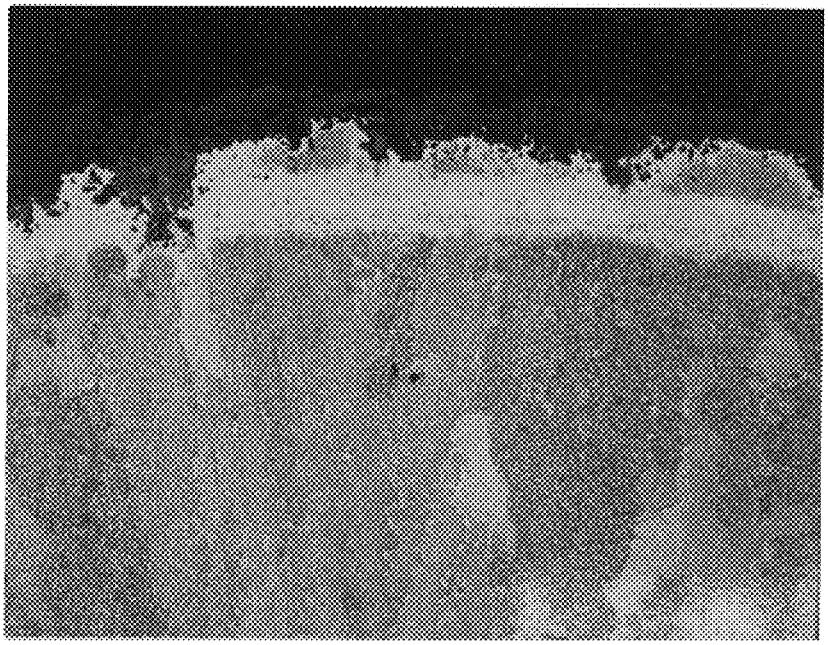
(FIG. 17A shows the prior art PtAl coating and FIG. 17B shows the inventive PtAl coating) on IN738.
Figure 17B:
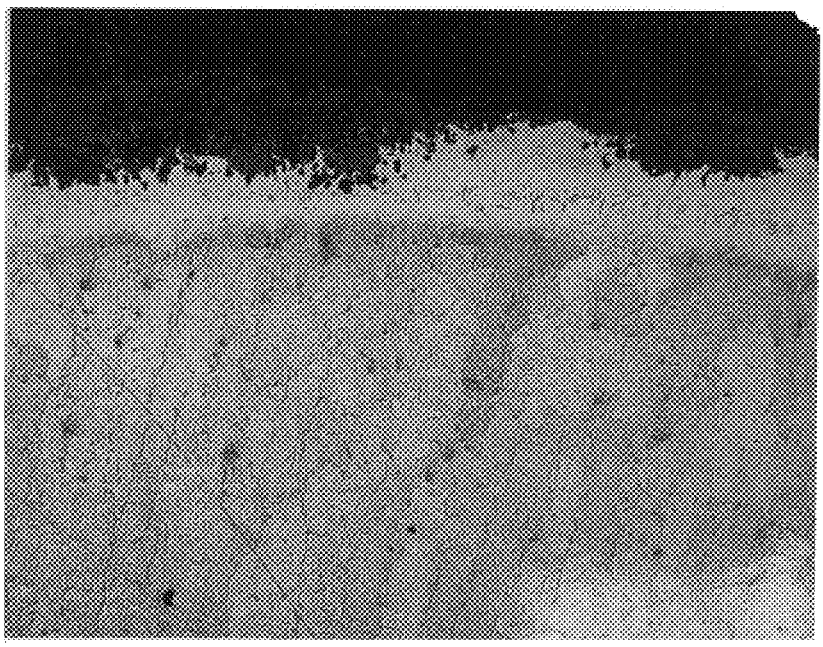

Pins were sectioned at two preselected locations and measurements made for each substrate/coating combination after exposure at times up to 1000 hours. FIG. 16 is a plot of the measured attack of prior art PtAl, improved PtAl, and simple aluminide on IN738 substrate after 1000 hr of exposure. For prior art PtAl and improved PtAl the penetration was confined to PtAl coating, while the measured penetration for simple aluminide represents a composite measurement through the coating and into the substrate. FIGS. 17A–B show representative attack for the prior art PtAl coating (FIG. 17A) and the improved PtAl coating (FIG. 17B) on IN738.

Porosity in prior art PtAl coatings on other substrates has been minimized by reducing the green coat weight in the first step or by the addition of alumina to Pt—Si AEP bath at 5–15 wt % levels It is to be appreciated that for simple shapes, such as the pins tested in hot corrosion, a satisfactory coating microstructure may be obtained by carefully controlling the Pt—Si green coat weight in the first step. However, for parts with more complex geometric shapes, this control is more challenging. The average green coat weight can be controlled, but there may be local variations in certain areas that may cause coating anomalies. Accordingly, the alumina doped inventive PtAl coating tested in hot corrosion provides the best means of diffused coating thickness and microstructural control for coating components with more complex geometry.

It is also to be appreciated that the inventive PtAl coating may be applied locally by brushing on a slurry of the coating composition to produce an effective "touch-up" coating where damage to the original coating has occurred. Alternatively, the slurry coating may be applied by spray application. This touch-up process is particularly suited for turbine vane repair since touch-up painting without alumina doping can result in a wide variation in green coating thickness and compromised diffused coating microstructures. As previously indicated, performance is adversely affected if too much Pt—Si is deposited in the first step. With alumina doping, acceptable coating microstructures are possible over a much broader range.

EXAMPLE 7

An article to be coated with a touch-up application is prepared by blending the damaged area to remove any sharp transition between the unaffected coating and the damaged area, lightly blasting with a suitable size abrasive, and mixing the Pt—Si powder with about 5 to 10 wt % finely divided alumina and the zein solution in isopropanol/nitromethane solvent, and painting on with a small artist type brush. After diffusion of the Pt—Si, the sample is lightly blasted, a slurry of Al—Cr is applied by brushing and subsequently heat treated to form the complete coating.

Further to this example, the inventive PtAl was produced on IN792 by brushing Pt—Si+7 wt % alumina, diffusing, lightly grit blasting, brushing Al—Cr, diffusing, and lightly grit blasting. An acceptable microstructure was produced, and the composition conformed to the 20 wt % Al and 10 wt % Pt minima specified.

It is also to be appreciated that the inventive technique may be extended to other powder compositions. One such example is the substitution of palladium (Pd) for platinum.

EXAMPLE 8

A desirable coating is produced on cobalt-base X-40 material by using the two-step electrophoretic method described above. The composition of the powder used in step 1 was 90% Pd, 5% Si, and 5% alumina, by weight. The composition of the powder used in step 2 was 70% Al and 30% Cr, by weight. The advantages of the alumina doping were documented. The microprobe composition analysis showed the incorporation of substantial amounts of the Pd into the coating microstructure.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of controlling the final coating thickness of a diffused aluminide coating on a metal substrate, said method comprising:

(a) depositing onto a metal substrate a coating of platinum-silicon powder;

(b) applying a heat treatment to the coated substrate to diffuse the platinum-silicon powder into the substrate;

(c) removing undiffused scale to leave a diffused Pt—Si enriched coating on the substrate;

(d) depositing a coating of an aluminum-bearing powder onto the platinum- and silicon-enriched substrate;

(e) applying a heat treatment to the coated substrate to diffuse the aluminum-bearing powder into the substrate; and (f) removing undiffused scale to leave a diffused Pt-modified aluminide coating on the substrate;

wherein said Pt—Si deposition is done using a Pt—Si powder that includes 7% to 20% by weight of an inert particulate.

2. The method of claim 1 wherein said Pt—Si deposition is done by electrophoretic deposition.

3. The method of claim 1 wherein said platinum-silicon powder is a prealloyed powder.

4. The method of claim 1 wherein said platinum-silicon powder is a mixture of Pt and Si.

5. The method of claim 1 wherein said platinum-silicon deposition is done by slurry deposition.

6. The method of claim 1 wherein said aluminum-bearing powder deposition is done by electrophoretic deposition.

7. The method of claim 1 wherein said aluminum-bearing powder is a prealloyed powder.

8. The method of claim 1 wherein said aluminum-bearing powder is a mixture of aluminum and at least one other metal.

9. The method of claim 1 wherein said aluminum-bearing powder deposition is done by slurry deposition.

10. The method of claim 1 wherein said inert particulate is alumina.

11. In a process for forming a platinum-silicon-enriched diffused aluminide coating on a superalloy substrate, wherein the process comprises; (a) electrophoretically depositing onto a metal substrate a coating of platinum-silicon powder; (b) applying a heat treatment to the coated substrate to diffuse the platinum-silicon powder into the substrate; (c) electrophoretically depositing an aluminum-bearing powder or prealloyed powder onto the platinum-silicon-enriched substrate; and (d) applying a heat treatment to the coated substrate to diffuse the aluminum-bearing powder or prealloyed powder into the substrate; the improvement comprising electrophorectically depositing the Pt—Si powder using an electrophoretic bath that is doped with 7% to 20% by weight of an inert particulate.

12. The method of claim 11 wherein said inert particulate is alumina.

13. A method of controlling the final coating thickness of a diffused aluminide coating on a metal substrate, said method comprising:

(a) depositing onto a metal substrate a coating of palladium-silicon powder;

(b) applying a heat treatment to the coated substrate to diffuse the palladium-silicon powder into the substrate;

(c) removing undiffused scale to leave a diffused Pd—Si enriched coating on the substrate;

(d) depositing a coating of an aluminum-bearing powder onto the palladium- and silicon-enriched substrate;

(e) applying a heat treatment to the coated substrate to diffuse the aluminum-bearing powder into the substrate; and (f) removing undiffused scale to leave a diffused palladium-modified aluminide coating on the substrate;

wherein said Pd—Si deposition is done using a Pd—Si powder that includes 7% to 20% by weight of an inert particulate.

14. The method of claim 13 wherein said inert particulate is alumina.

* * * * *

UNITED STATES PATENT AND TRADEMARK OFFICE

CERTIFICATE OF CORRECTION

PATENT NO : 5,958,204

DATED : September 28, 1999

INVENTOR : George Edward Creech et al.

It is certified that errors appear in the above-identified patent and that said Letters Patent are hereby corrected as shown below:

On the front page of the patent, please change the Assignee from "Allison Enaine Company, Inc." to –Allison Engine Company, Inc.--.

In column 1, line 45, please insert --See-- after the word "aluminum."

Signed and Sealed this

Eighth Day of May, 2001

*Attest:*

Nicholas P. Godici

NICHOLAS P. GODICI

*Attesting Officer*

*Acting Director of the United States Patent and Trademark Office*